US006523917B2

(12) United States Patent
Twellmann

(10) Patent No.: US 6,523,917 B2
(45) Date of Patent: Feb. 25, 2003

(54) MOUNTING STRUCTURE FOR A DOOR OF A CORNER CABINET

(75) Inventor: Günter Twellmann, Spange (DE)

(73) Assignee: Ninkaplast GmbH, Bad Salzuflen (DE)

( * ) Notice: Subject to any disclaimer, the term of this patent is extended or adjusted under 35 U.S.C. 154(b) by 0 days.

(21) Appl. No.: 09/768,071

(22) Filed: Jan. 23, 2001

(65) Prior Publication Data

US 2001/0013743 A1 Aug. 16, 2001

(30) Foreign Application Priority Data

Feb. 10, 2000 (DE) ..... 200 02 313 U

(51) Int. Cl.[7] ..... A47F 3/10
(52) U.S. Cl. ..... 312/238; 312/305
(58) Field of Search ..... 312/238, 125, 312/135, 305; 211/144; 108/103, 105

(56) References Cited

U.S. PATENT DOCUMENTS 3,868,156 A 2/1975 Vander Ley
4,181,037 A * 1/1980 Boon et al. ..... 312/125 X
5,273,353 A 12/1993 Twellmann

FOREIGN PATENT DOCUMENTS

| | | | | |
|---|---|---|---|---|
| DE | 2722629 | * | 9/1978 | ..... 312/238 |
| DE | 29919619 | | 2/2000 | |
| EP | 451737 | * | 10/1991 | ..... 312/238 |
| EP | 563933 | * | 10/1993 | ..... 312/238 |

* cited by examiner

*Primary Examiner*—Janet M. Wilkens
(74) *Attorney, Agent, or Firm*—Richard M. Goldberg

(57) ABSTRACT

A mounting structure for mounting a door to a carrousel of a corner cabinet, wherein the carrousel has a plurality of shelves and a rotary axis, and the door is co-rotatable with the carrousel and is radially movable relative thereto, the mounting structure including a continuous, vertically extending casing which supports the shelves of the carrousel and accommodates further component parts of the mounting structure, the casing being formed by a column which is shaped as a hollow profile and is offset from the rotary axis of the carrousel; a pair of upper and lower bearing constructions rotatably supporting, the carrousel, and a pair of cantilever arms connecting the column to each of the bearing constructions.

16 Claims, 4 Drawing Sheets

MOUNTING STRUCTURE FOR A DOOR OF A CORNER CABINET

BACKGROUND OF THE INVENTION

The invention relates to a mounting structure for mounting a door to a carrousel of a corner cabinet such that the door is co-rotatable with the carrousel and is radially movable relative thereto, the mounting structure comprising a continuous, vertically extending casing which interconnects shelves of the carrousel and accommodates other component parts of the mounting structure.

In a mounting structure of this type, which is known from U.S. Pat. No. 5,273,353, the casing is clamped to an axis which is rotatably supported in the comer cabinet and defines the rotary axis of the carrousel and at which the shelves are supported. Thus, the casing of the mounting structure extends to the rotary axis which passes through the center of the individual shelves, and, as a result, a comparatively large portion of the storage area of the shelves is lost. In particular in case of relatively small hanging-type corner cabinets, it would therefore be desirable to utilise the storage area of the shelves more efficiently.

U.S. Pat. No. 3,868,156 discloses a carrousel for corner cabinets, in which the shelves are directly mounted to an angle door which itself is supported by upper and lower bearing constructions of the carrousel through cantilever arms. Here, it is however not possible to move the door relative to the shelves of the carrousel in radial direction. As a consequence, the door and the door opening must have a design which permits the common rotary motion of the carrousel and the door. Then, it is difficult to achieve a construction in which the door opening is neatly and essentially tightly closed-off by the door.

SUMMARY OF THE INVENTION

It is an object of the invention to provide a mounting structure for a door of a corner cabinet which permits a radial movement of the door and nevertheless makes it possible to efficiently utilise the storage area of the shelves.

According to the invention, this object is achieved by the feature that the casing is formed as a column which is shaped as a hollow profile and which supports the shelves and is offset from the rotary axis of the carrousel and is supported at upper and lower bearing constructions of the carrousel through cantilever arms.

Thus, according to this solution, the conventional continuous axis defining the rotary axis of the carrousel is replaced by a column which is arranged eccentrically and is connected to the upper and lower bearing constructions, that are arranged on the rotary axis, only through cantilever arms. Thus, similarly as in the carrousel known from U.S. Pat. No. 3,868,156, the storage area of the shelves can be used more efficiently. However, according to the invention, this column forms also the casing which accommodates the component parts of the mounting structure which permits the radial movement of the door relative to the shelves. As a result a very compact and simple construction is achieved which nevertheless permits to move the door radially outwardly into the closed position, so that the door opening can be closed essentially dust-tight and in an aesthetically satisfactory way.

BRIEF DESCRIPTION OF THE DRAWINGS

An embodiment example of the invention will now be described in detail in conjunction with the drawings, in which.

DESCRIPTION OF A PREFERRED EMBODIMENT

Figure 1:
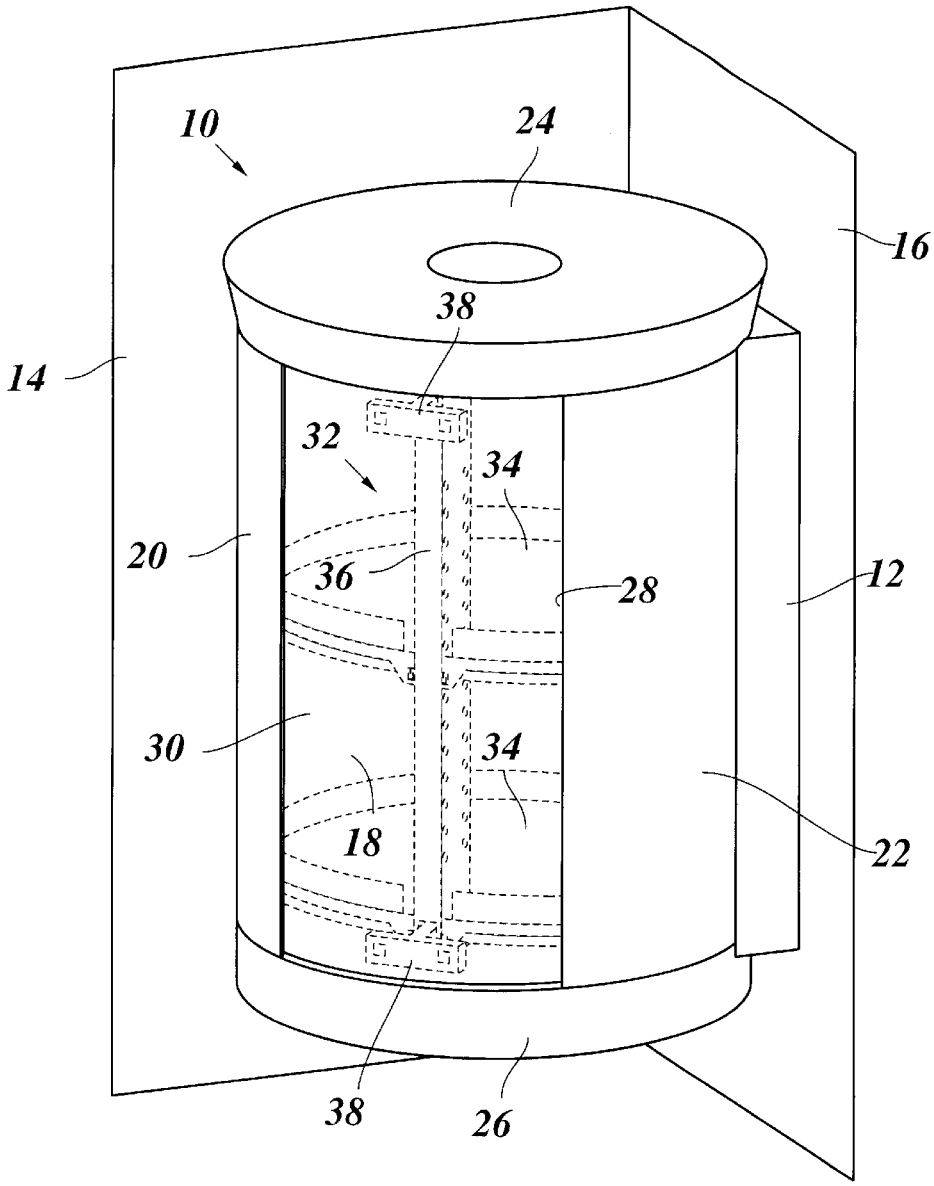
FIG. 1 is a perspective view of a hanging-type corner cabinet.

FIG. 1 shows a cylindrical comer cabinet 10 which, by means of a support structure 12, is hangingly mounted in a corner between two orthogonal walls 14, 16 of a room. The corner cabinet 10 has convexly curved side walls 20, 22 which are formed by extruded profiles of aluminium and which are interconnected by a curved rear wall 18. The comer cabinet is closed at the upper end by a head 24 formed by a double-walled disk of molded plastics and at the lower end by a bottom plate 26 which is also molded from plastics. The head 24 and the bottom plate 26 are connected to the side walls 20 and 22 by screws which have not been shown. The vertical front edges of the side walls 20 and 22 define a door opening 28 which can be closed-off by a door 30. The door 30 is convexly curved in the shown embodiment but may alternatively have a flat or concavely curved shape.

Inside of the comer cabinet 10 there is mounted a carrousel 32 which is rotatable about the vertical central axis of the cylindrical comer cabinet and comprises a plurality of shelves 34. The shelves 34 are interconnected by a vertical column 36 which is offset relative to the rotary axis of the carrousel and to which a bracket 38 for supporting the door 30 is mounted at the upper end and the lower end, respectively. The brackets 38, and with them also the door 30, are guided in the column 36 for movement in radial direction of the carrousel and are elastically biased outwardly, so that the door 30, when it is in the closed position, is pressed against the edges of the side walls 20 and 22 from inside.

When the door 30 is pressed inwardly against the elastic bias, the carrousel can be rotated such that the door leaves the door opening 28 open. As is well known in the art, a cam disk which is mounted on the bottom plate 26 and which has not been shown in FIG. 1 controls the radial movement of the door 30 and the brackets 38 in such a way that the door can only return into its radial outward position when the carrousel has again assumed an angular position in which the door is flush with the door opening 28.

Figure 2:
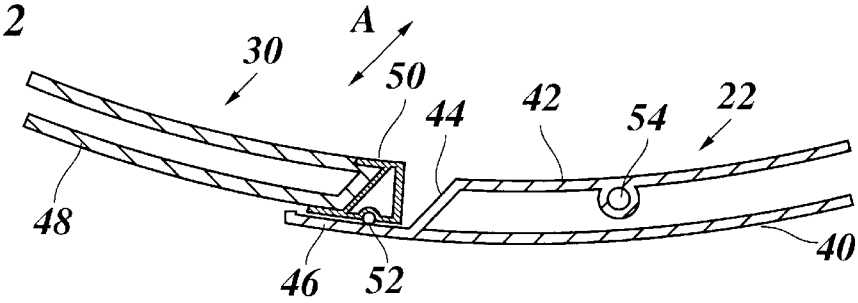
FIG. 2 is a horizontal section through parts of a side wall and a door of the comer cabinet shown in FIG. 1.

FIG. 2 shows a horizontal cross-section through a part of the side wall 22 and an edge portion of the door 30 adjacent to this side wall. The side wall 22 is formed as a hollow profile and has an outer wall 40 and an inner wall 42 which are interconnected by a web 44 in the vicinity of the door opening. The web 44 is inclined such that it does not restrict the radial inward and outward movement of the door 30 (double arrow A). Adjoining to the web 44, there is provided a door stop 46 which projects into the door opening and is formed by only a single layer of material and which prolongs the outer wall 40 such that no transition between the outer wall 40 and the door stop 46 is visible from the outside. The edge at the free end of the door stop 46 is slightly curved inwardly towards the door 30.

In the shown embodiment, the door 30 has a door body 48 which is formed by an extruded hollow profile of aluminium. The edge of the door body 48 is framed by a profile strip 50 which is hidden behind the door stop 46 and to which a seal 52 is fitted outside of the contour of the door body 48. When the door is closed, the seal 52 is in sealing engagement with the internal surface of the door stop 46, so that the door opening is perfectly sealed.

The seal 52 and the leg of the profile strip 50 accommodating the same are raised only slightly beyond the outer surface of the door body 48, so that only a minimal gap occurs between the edge of the door stop 46 and the door body 48. The length of the door stops 46 in circumferential direction is so dimensioned that the door 30 is received with a little play between the webs 44 of the side walls 22 and 20. Thus, a certain misalignment of the door can be tolerated without a re-adjustment being necessary.

In the hollow space defined by the side wall 22, there has been shown one of a plurality of screw channels 54 which serve for fixing the bottom plate 26 and the head 24.

Figure 3:
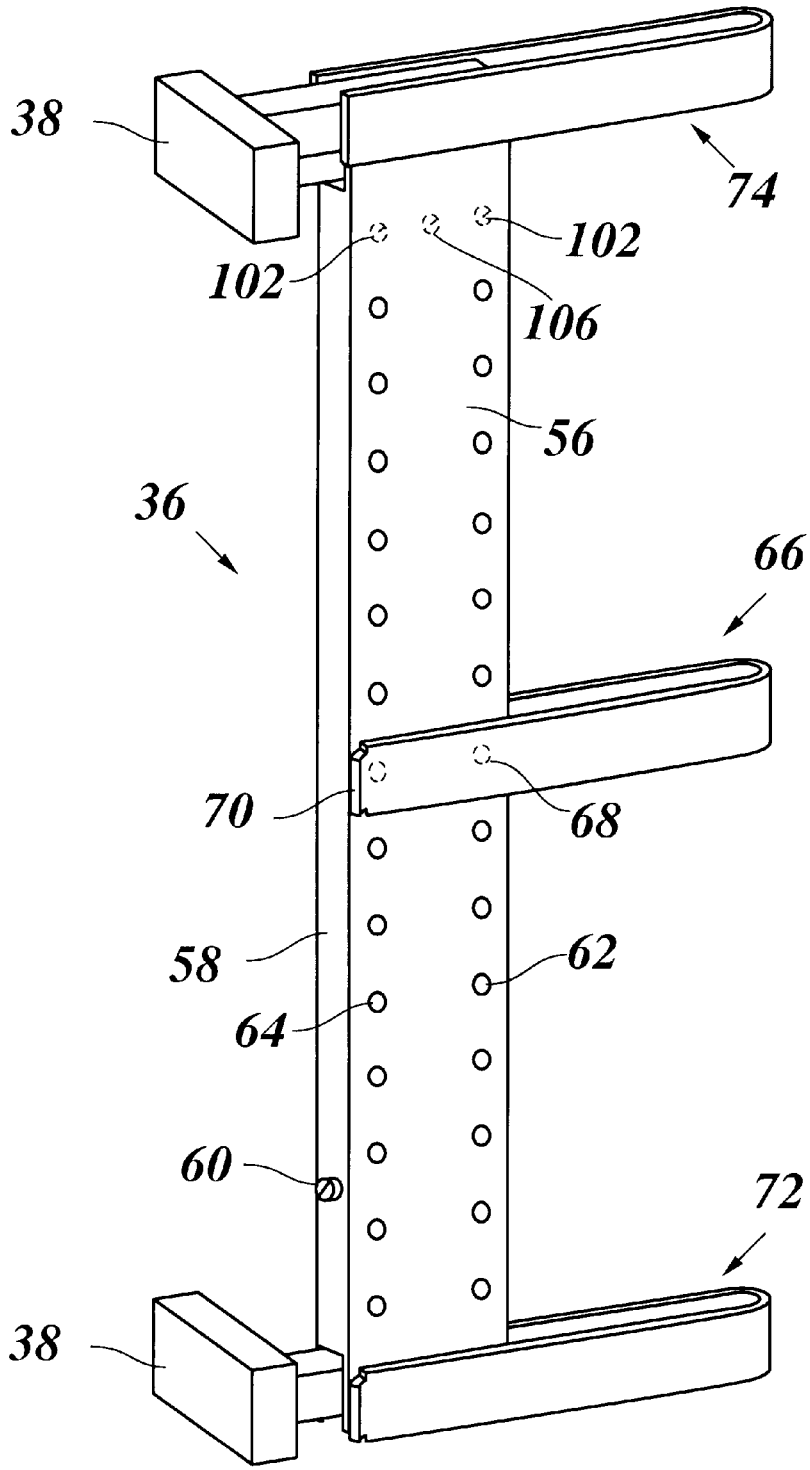
FIG. 3 is a perspective view of a column of a carrousel of the comer cabinet having a door mounting structure and support arms for supporting shelves.

The column 36, which has been shown separately in FIG. 3, is formed by an extruded profile of aluminium and has a U-shaped cross-section elongated in radial direction of the carrousel, with the parallel legs 56 of the U-shape projecting outwardly. In the central portion of the column, the free ends of the legs 56 are closed-off by a wall 58 which leaves open only the guides for the brackets 38 at 30 the upper and lower end. The brackets 38, which have only been shown schematically herein, can, in a well-known manner, be provided with adjusting means allowing to adjust the height and, if necessary, also the lateral position of the door. In the vicinity of the lower end of the wall 58 there is provided a set screw 60 which permits to adjust the depth position of the door in the closed state, as will be described below.

Each leg 56 of the column is provided in the vicinity of its inner and outer edge with a row of holes 62, 64, respectively, which are arranged with uniform spacings.

In an intermediate height position, the column 36 carries a support arm 66 which serves to support one of the shelves 34. This support arm is formed by a metal bracket in U-shape, which grips around the column 36 and the closed end of which reaches out to the center, i.e. the rotary axis of the carrousel. Each of the parallel legs of the support arm 66 has, on the inner side, two projections 68 which are held in engagement with one of the holes 62 and one of the holes 64, thanks to the own elasticity of the bracket-shaped support arm. Thus, the support arm 66 is held at the column 36 and is stabilised against tilting movement.

Each of the two legs of the support arm 66 has at its free end a lug 70 which is slightly bent outwardly. These lugs have the function to immobilise the shelf 34 in vertical direction at the support arm 66, as will be described later.

At the lower end of the column 36 there is provided another support arm 72 which differs from the support arm 66 only in that is not height-adjustable but is fixedly welded to the column.

Figure 4:
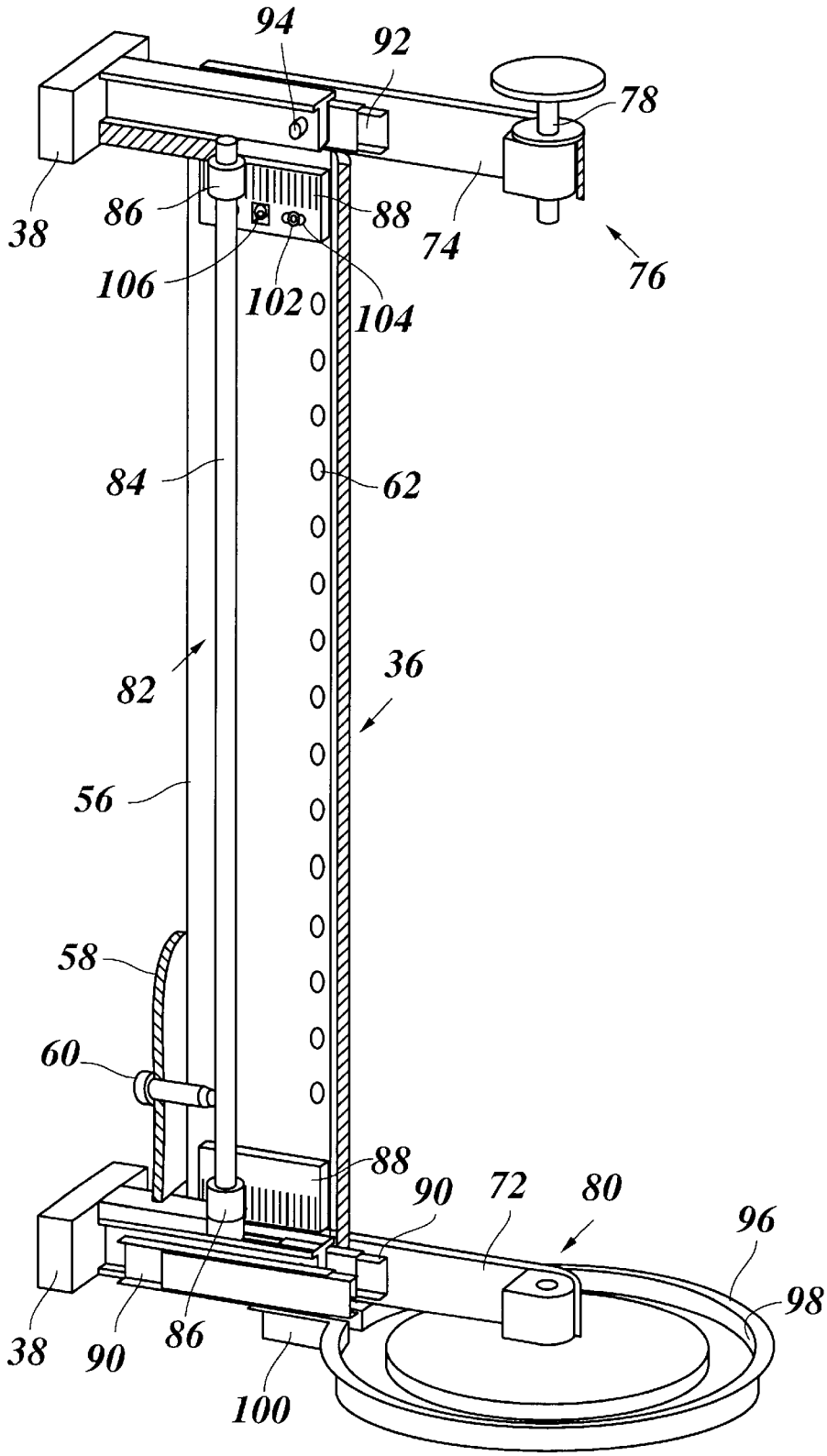
FIG. 4 shows details of the door mounting structure inside of the column.

Welded to the top end of the column 36 is a cantilever arm 74 which has essentially the same shape as the support arms 66 and 72 but does not serve for supporting a shelf, but serves only for accommodating a bearing construction 76 which has been shown in FIG. 4 and with which the upper end of the carrousel is rotatably supported at the head 24 of the corner cabinet. The bearing construction 76 has a telescopic shaft 78 which may be adapted to different heights of the corner cabinet.

The lower support arm 72 carries at its inner end a bearing construction 80 with which the lower end of carrousel is rotatably supported at the bottom plate 26 of the corner cabinet.

The intermediate support arm 66 has not been shown in FIG. 4. In the drawing, a part of the column 36 has been broken away so as to show a door fitting 82 which is accommodated inside of the column and which permits the radial inward and outward movement of the door 30. With this fitting, a jam-free radial movement of the door is achieved by means of a synchronising shaft 84 which passes vertically through the interior of the column 36 and is rotatably supported in the brackets 38 with its upper and lower ends. In the vicinity of each of its upper and lower ends the synchronising shaft 84 has a pinion 86 which meshes with a rack 88 fixed to the internal surface of one of the legs 56 of the column 36.

The lower door bracket 38 is smoothly guided in the column 36 with two ball bearing slides 90, whereas only a single ball bearing slide 92 is provided for the upper bracket 38. In case of the upper bracket 38 there can also be seen a pin 94 at which a non-shown tension spring is anchored, which biases the bracket 38 and hence the door 30 radially outwardly. The other end of the tension spring is anchored at the internal surface of the leg of the column 36 which has been broken away in FIG. 4. The lower bracket 38 is also biased outwardly by a corresponding tension spring. The synchronising shaft 84 meshing with the racks 88 ensures that the upper and lower brackets will always move in synchronism.

Fixed to the bottom plate 26 of the corner cabinet is a cam disk 96 which surrounds the lower bearing construction 80. A stud which is provided at the bottom side of the bracket 38, and which cannot be seen in the drawing, projects into this cam disk. The cam disk 96 defines a circular guide 98 having a radial extension 100. In the condition shown in FIG. 4, the door is in the closed state in its radial outward position. In this state, the stud is accommodated in the extension 100. When the door is pressed inwardly and, then, the carrousel is turned, the lower bracket, and hence the door in its entirety, will be held in an inwardly withdrawn position in which the door does not abut at the side walls or the rear wall of the corner cabinet. As soon as the door has reached again a position flush with the door opening 28, it returns automatically into the closed position, under the action of the tension spring mentioned above.

The set screw 60 forms an adjustable stop for the synchronising shaft 84 and thereby determines the radial position of the door in the closed state.

An adjustment of the tilt position of the door is achieved by the fact that at least the upper rack 88 is radially adjustable relative to the column 36. This upper rack 88 is fixed to the leg 56 of the column 36 by means of two fastening screws 102 which pass through elongated holes 104 of the rack. After the fastening screws 102 have been loosened, a smooth adjustment can be made by means of an eccentric cam 106. The tilt position of the synchronising shaft 84 and, accordingly, also the tilt position of the door 30, which is parallel to the equaliser shaft, is adjusted by the radial displacement of the upper rack 88 relative to the column 36 and hence also relative to the lower rack. When the tilt position has been adjusted such that the door smoothly engages the door stops 46 over its entire height, the fastening screws 102 are tightened again.

In FIG. 3, the heads of the fastening screws 102 and of the eccentric cam 106, which can be actuated by means of screw drivers, would be invisible because they would lie on the back side of the column 36. However, for illustration purposes, their positions have been indicated in phantom lines on the "wrong" side of the column.

Figure 5:
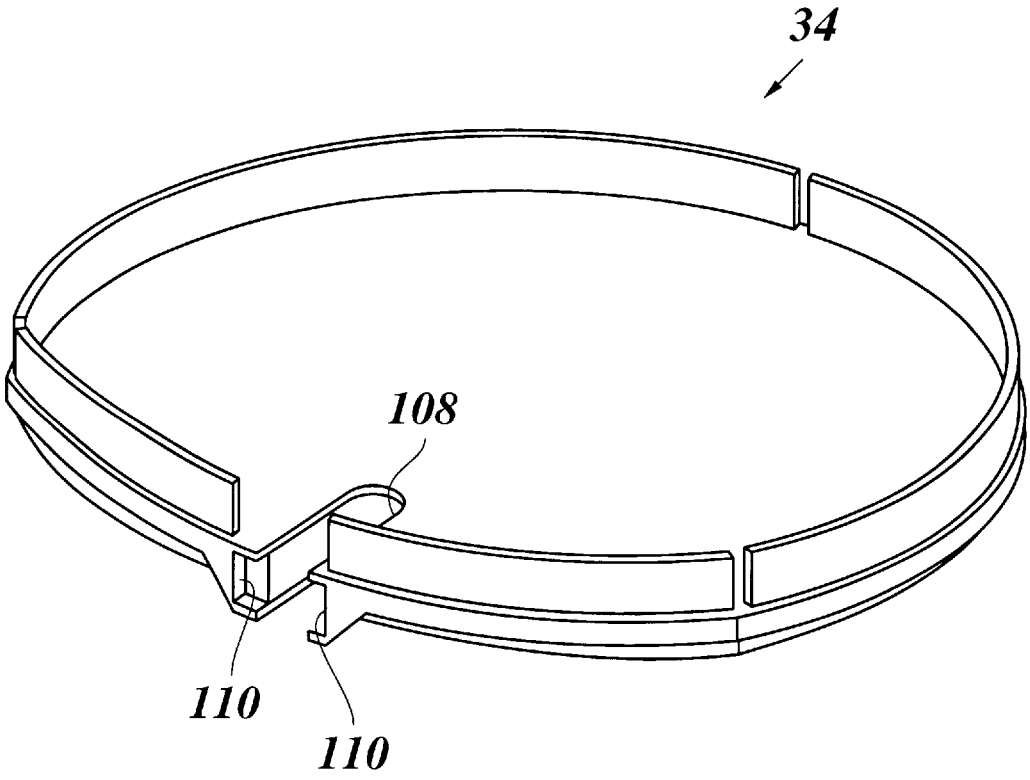
FIG. 5 is a perspective view of a shelf.

FIG. 5 shows one of the shelves 34 which are mounted on the support arms 66 and 72. The contour of the shelf 34 is, on the major part of its periphery, defined by a circular arc which is concentric with the rotary axis and is matched to the internal contour of the corner cabinet 10. In the vicinity of the door, the shelf is bounded by a curved line having a smaller curvature which is adapted to the curvature of the door 30. In the center of this less curved edge portion, a slot 108 can be seen which extends radially from the edge to the inside and which is matched to the outer cross-sectional shape of the column 36. The portion of the shelf below the slot 108 is thickened, and the walls of the slot 108 define two recesses 110 which accommodate the previously mentioned lugs 70 of the support arm 66 and 72, respectively. Thus, the shelf 34 is positively—in vertical direction —locked to the associated support arm and is prevented from tilting. If desired, the bracket-shaped support arm 66 may be shaped such that the free ends of its legs are slightly compressed by the side walls of the slot 108. This would not only secure the engagement of the projections 68 in the holes 62 and 64 but would also immobilise the shelf on the support arm in a press-fitting manner.

What is claimed is:

1. A combination of a carrousel for a corner cabinet, a door therefor and a mounting structure for mounting the door to the carrousel, comprising:

a carrousel including:

a plurality of shelves;

a rotary axis;

a continuous, vertically extending casing which supports the shelves of the carrousel, the casing being formed by a column which is shaped as a hollow profile and is offset from the rotary axis of the carrousel;

a pair of upper and lower bearing constructions rotatably supporting the carrousel;

a pair of connecting arms connecting the column to each of the bearing constructions;

a door co-rotatable with the carrousel and radially movable relative thereto; and a mounting structure for mounting the door to the carrousel.

2. A combination according to claim 1, wherein said mounting structure further includes:

upper and lower brackets to which the door is mounted, a synchronizing shaft which interconnects the brackets, pinions arranged near upper and lower ends of the synchronizing shaft, and radially extending racks provided at the carrousel and with which the pinions mesh, and at least one of the racks is adjustable in a radial direction of the carrousel.

3. A combination according to claim 2, wherein the column has an elongated cross-section forming two parallel legs, and the racks are mounted to an internal surface of one of the parallel legs.

4. A combination according to claim 3, wherein at least one of the column and at least one adjustable rack has elongated holes, and at least one rack is adjustably secured to the column with fastening screws passing through the elongated holes.

5. A combination according to claim 4, wherein said mounting structure includes an eccentric cam for finely adjusting the radial position of the at least one adjustable rack.

6. A combination according to claim 2, wherein said mounting structure includes an adjustable stop which, for limiting the radial outward movement of the door, co-operates with a section of the synchronizing shaft remote from the at least one adjustable rack.

7. A combination according to claim 6, wherein the adjustable stop is formed by a set screw screwed into a wall of the column.

8. A combination according to claim 1, wherein the pair of connecting arms are cantilever arms.

9. A combination of a carrousel for a corner cabinet, a door therefor and a mounting structure for mounting the door to the carrousel, comprising:

a carrousel including:

a plurality of shelves;

a rotary axis;

a continuous, vertically extending casing which supports the shelves of the carrousel, the casing being formed by a column which is shaped as a hollow profile and is offset from the rotary axis of the carrousel;

a pair of upper and lower bearing constructions rotatably supporting the carrousel;

a pair of connecting arms connecting the column to each of the bearing constructions;

a door co-rotatable with the carrousel and radially movable relative thereto; and a mounting structure for mounting the door to the carrousel, the mounting structure including a mechanism accommodated in the hollow profile of the column for controlling radial movement of the door relative to the carrousel.

10. A combination according to claim 9, wherein said mounting structure further includes:

upper and lower brackets to which the door is mounted, a synchronizing shaft which interconnects the brackets, pinions arranged near upper and lower ends of the synchronizing shaft, and radially extending racks provided at the carrousel and with which the pinions mesh, and at least one of the racks is adjustable in a radial direction of the carrousel.

11. A combination according to claim 10, wherein the column has an elongated cross-section forming two parallel legs, and the racks are mounted to an internal surface of one of the parallel legs.

12. A combination according to claim 11, wherein at least one of the column and at least one adjustable rack has elongated holes, and at least one rack is adjustably secured to the column with fastening screws passing through the elongated holes.

13. A combination according to claim 12, wherein said mounting structure includes an eccentric cam for finely adjusting the radial position of the at least one adjustable rack.

14. A combination according to claim 10, wherein said mounting structure includes an adjustable stop which, for limiting the radial outward movement of the door, co-operates with a section of the synchronizing shaft remote from the at least one adjustable rack.

15. A combination according to claim 14, wherein the adjustable stop is formed by a set screw screwed into a wall of the column.

16. A combination according to claim 9, wherein the pair of connecting arms are cantilever arms.

* * * * *